US005933120A

United States Patent [19]

Manasson et al.

[11] Patent Number: 5,933,120

[45] Date of Patent: Aug. 3, 1999

[54] 2-D SCANNING ANTENNA AND METHOD FOR THE UTILIZATION THEREOF

[75] Inventors: Vladimir A. Manasson, Los Angeles; Lev S. Sadovnik, Irvine, both of Calif.

[73] Assignee: WaveBand Corporation, Torrance, Calif.

[21] Appl. No.: 08/764,894

[22] Filed: Dec. 16, 1996

[51] Int. Cl.[6] ..... H01Q 7/08; H01Q 13/00; H01Q 13/10

[52] U.S. Cl. ..... 343/788; 343/785; 343/776; 343/772; 343/781 R

[58] Field of Search ..... 343/788, 785, 343/781 R, 776, 772

[56] References Cited

U.S. PATENT DOCUMENTS

| | | | |
|---|---|---|---|
| 2,993,205 | 7/1961 | Cooper | 343/785 |
| 3,848,256 | 11/1974 | Craven et al. | 343/768 |
| 4,204,212 | 5/1980 | Sindoris et al. | 343/830 |
| 5,014,069 | 5/1991 | Seiler et al. | 343/785 |
| 5,305,123 | 4/1994 | Sadovnik | 359/4 |
| 5,572,228 | 11/1996 | Manasson et al. | 343/785 |

*Primary Examiner*—Donald Hajec
*Assistant Examiner*—Daniel St. Cyr
*Attorney, Agent, or Firm*—Nilles & Nilles, S.C.

[57] ABSTRACT

Systems and methods for two dimensional millimeter wave imaging are described. A system includes a spindle assembly defining a rotation axis; a waveguide assembly connected to the spindle assembly, the waveguide assembly including a first dielectric waveguide defining a first axis; and a grating assembly connected to the spindle assembly, the grating assembly including a plurality of sectors, each of the plurality of sectors including a varying period conductive grating pattern. A varying period of the varying period conductive grating pattern is a function of an angle defined by a rotational position of the grating assembly with regard to the rotation axis. The systems and methods provide advantages in that an image can be scanned quickly using an inexpensive system.

42 Claims, 9 Drawing Sheets

2-D SCANNING ANTENNA AND METHOD FOR THE UTILIZATION THEREOF

BACKGROUND OF THE INVENTION

1. Field of the Invention

The present invention relates generally to the field of antennas. More particularly, the present invention relates to antennas that scan in two dimensions. Specifically, a preferred embodiment of the present invention relates to an evanescent coupling millimeter wave (MMW) antenna wherein two dimensional (2-D) scanning is provided via a rotating waveguide assembly and a separately rotating grating disk. The present invention thus relates to an antenna of the type that can be termed rotational scanning.

2. Discussion of the Related Art

Within this application several publications are referenced by arabic numerals within parentheses. Full citations for these, and other, publications may be found at the end of the specification immediately preceding the claims. The disclosures of all these publications in their entireties are hereby expressly incorporated by reference into the present application for the purposes of indicating the background of the present invention and illustrating the state of the art.

Millimeter wave (MMW) imaging can be defined as picture-taking using a longer (compared to light) wavelength portion of the electromagnetic spectrum. In active imaging, the object or the scene is illuminated by an MMW transmitter and the reflected or scattered energy is intercepted by a receiving antenna. In passive imaging, the difference in the thermal radiation from objects filling the imaged scene is perceived by an antenna and an associated detector (radiometer).

MMW imaging, although inferior in resolution to optical imaging, provides imagery that is less susceptible to adverse weather or atmospheric conditions. These advantages make MMW imaging particularly well suited for astronomical and earth sciences applications. Further, MMW imaging has significantly greater penetration if look-through capability is desired, (e.g., in concealed weapon detection or industrial inspection).

A MMW imaging system consists of three major components: an antenna, a receiver and a signal processing unit.[1] The receiver can be either a heterodyne mixer or a low noise amplifier (LNA) with a detector. Recently, significant progress has been made in developing MMW receivers. However, the lack of a fast scanning antenna to form an image continues to present a bottleneck to the development of a cost-effective MMW imaging system.

In radiometric applications, antenna performance is of particular importance. Gain, ohmic losses, and sidelobe levels are parameters that are of major importance. The primary figure of merit for radiometry is the gain, and a secondary factor is the equivalent noise temperature.

Traditional mechanically scanning antennas have the disadvantage of inertia that must be overcome at the beginning and at the end of each scan.[2] For example, conventional dish (parabolic) antennas are bulky and therefore too slow in two-dimensional raster scanning. Electronically scanned antennas, on the other hand, are fast but have a high noise figure and are expensive. For example, electronically steered phased array antennas are, at MMW frequencies, too lossy and prohibitively expensive. Nevertheless, several imaging systems based on heterodyne and direct detection of MMW energy have been developed.

One unsatisfactory previously recognized approach, in an attempt to solve the problems referred to above, involves using a parabolic dish radiometer with two axis scanning to construct an image. In this parabolic dish approach, an operating frequency of 35 GHz was used, resulting in an angular resolution of approximately 1°. Using single sideband detection, an antenna noise temperature of 1000° K was reported. Considerable scan time was required to form the image, (e.g., minutes), the bulk of the time having been needed to move and stabilize the antenna dish. This time factor is the main problem with using a large dish antenna to form an image since long scan times are incompatible with most moving objects.

Another unsatisfactory previously recognized approach, in an attempt to solve the problems referred to above, uses the forward movement of an aircraft to construct an image along the flight path. In this approach only one-dimensional scanning by the antenna is needed because the movement of the aircraft provides a quasi-second-dimensional scan for imaging.

Yet another unsatisfactory previously recognized approach, in an attempt to solve the problems referred to above, uses an MMW analog of an infrared (IR) focal plane array. In this approach, an 8×8 element receiver array operates at 94 GHz and utilizes a 63 cm lens to form an image at the focal plane. The reported pixel, (i.e., antenna), noise temperature of 4000° K is much higher than that for a mechanically scanning system. Like the scanning parabolic dish, the focal plane array approach requires very long, (e.g., minutes), integration times. Further, this MMW focal plane array approach does not provide an economically viable solution for MMW imaging. Summarizing recent progress in MMW receiver technology, it can be concluded that what is needed is a single MMW receiver element with a very high temperature resolution (≦0.01° K) and an imaging system that utilizes either a single such receiver or a small number of them.

The below-referenced U.S. Patent, and allowed U.S. Patent Application in which the issue fee has been paid, disclose embodiments that are satisfactory for the purposes for which they were intended. The disclosures of the below-referenced prior U.S. Patent, and U.S. Patent Application, in their entireties are hereby expressly incorporated by reference into the present application for purposes including, but not limited to, indicating the background of the present invention and illustrating the state of the art.

U.S. Pat. No. 5,305,123 discloses a light controlled spatial and angular electromagnetic wave modulator. U.S. Ser. No. 08/382,493, filed Feb. 1, 1995, discloses an evanescent coupling antenna and method of utilization thereof.

SUMMARY AND OBJECTS OF THE INVENTION

By way of summary, the present invention is directed to 2-D MMW imaging. Unexpected beneficial effects of the present invention, which are substantial improvements, include achieving a fast 2-D scan, employing only a single receiver and obtaining commercial viability through inexpensive mass production.

A primary object of the invention is to provide an apparatus that scans in two dimensions. Another object of the invention is to provide an apparatus that is cost effective. It is another object of the invention to provide an apparatus that is rugged and reliable, thereby decreasing down time and operating costs. It is yet another object of the invention to provide an apparatus that has one or more of the characteristics discussed above but which is relatively simple to manufacture and assemble using a minimum of equipment.

In accordance with a first aspect of the invention, these objects are achieved by providing an imaging antenna comprising: a spindle assembly defining a rotation axis, said spindle assembly including: a first rotational mounting for attachment to a platform so as to permit rotational motion about said rotation axis; a shaft attached to said rotational mounting, said shaft being capable of rotational motion about said rotation axis; a drive gear attached to said shaft; a pinion gear attached to said drive gear; and a first motor attached to said pinion gear; a waveguide assembly rotatably connected to said shaft so as to permit said waveguide assembly to rotate about said rotation axis, said waveguide assembly including: a first dielectric waveguide defining a first axis that is substantially perpendicular to said rotation axis; a first elongated cylindrical lens that i) is electromagnetically coupled to said first dielectric waveguide and ii) defines a lens axis that is substantially perpendicular to said rotation axis; a second dielectric waveguide defining a second axis that is substantially parallel to said first axis; and a second elongated cylindrical lens that i) is electromagnetically coupled to said second dielectric waveguide and ii) defines a lens axis that is substantially perpendicular to said rotation axis; and a grating assembly rotatably connected to said shaft with a second rotational mounting so as to permit said grating assembly to rotate about said rotation axis independently of said waveguide assembly, said grating assembly including: a reflective layer defining a plane that is substantially normal to said rotation axis; and a plurality of sectors, each of said plurality of sectors including a varying period conductive grating pattern of separated strips, wherein a varying period of said varying period conductive grating pattern of separated metal strips is a function of an angle defined by a rotational position of said grating assembly with regard to said rotation axis. In a preferred embodiment, the imaging antenna further comprises an optical link, said optical link including: a diode laser connected to said shaft; and a photodiode i) connected to said platform and ii) electromagnetically coupled to said diode laser.

Another object of the invention is to provide a method of operating a physical display that can be used to obtain scanning data in polar coordinates and then convert that data to Cartesian coordinates. It is another object of the invention to provide a method that is predictable and reproducible, thereby decreasing variance and operating costs. It is yet another object of the invention to provide a method that has one or more of the characteristics discussed above but which is relatively simple to setup and operate using modest computer resources.

In accordance with a second aspect of the invention, these objects are achieved by providing a method of operating a physical display, comprising: collecting a first set of polar coordinate data including a data point a and a data point d; collecting a second set of polar coordinate data including a data point b and a data point c; transforming said first set of polar coordinate data and said second set of polar coordinate data into a set of Cartesian coordinate data; determining whether a threshold has been exceeded; and transforming said physical display, if said threshold has been exceeded, wherein a value at a point p in Cartesian coordinates is approximated by a weighted sum of a set of four nearest polar neighbors, said set of four nearest polar neighbors including a, b, c and d, according to a relationship $$F(p) = \frac{(1/l_a)F(a) + (1/l_b)F(b) + (1/l_c)F(c) + (1/l_d)F(d)}{1/l_a + 1/l_b + 1/l_c + 1/l_d}$$

where $l_a$, $l_b$, $l_c$ and $l_d$ are distances from p to a, b, c and d, respectively and F(a), F(b), F(c) and F(d) are polar coordinate data at a, b, c and d, respectively and F(p) is Cartesian coordinate data at p.

Another aspect of the invention is to provide an apparatus for remotely detecting concealed weapons. Another object of the invention is to provide an apparatus that provides an enhanced depth of field. It is yet another object of the invention to provide an apparatus that has one or more of the characteristics discussed above but which is itself compact and concealable.

In accordance with a third aspect of the invention, these objects are achieved by providing an apparatus, comprising: a spindle assembly defining a rotation axis; a waveguide assembly connected to said spindle assembly, said waveguide assembly including: a plurality of waveguides; a load electromagnetically connected to each of said plurality of waveguides; and a plurality of transceivers, each of said plurality of transceivers being electromagnetically connected to one of said plurality of waveguides; a grating assembly connected to said spindle assembly, said grating assembly including: a substrate having a thickness a and reflective layer connected to said substrate, said reflective layer defining a plane that is substantially normal to said rotation axis, wherein $$a=\lambda \cos \phi/(4\in_d^{1/2})$$

where $\phi$ is a center of an angular scanning range, $\lambda$ is the wavelength of an electromagnetic source and $\in_d$ is a dielectric constant of said substrate; a plurality of microstrip patches connected to said substrate, each of said microstrip patches including a conductive grating pattern, said plurality of microstrip patches being grouped in a plurality of spirally distributed sets, each of said spirally distributed sets including a plurality of narrow band resonator emitters; and a grating mounting for rotatably attaching said grating assembly to said spindle assembly so as to permit said grating assembly to rotate about said rotation axis; and a zone plate that is optically coupled to each of said plurality of waveguides, said zone plate defining a plate plane that is substantially perpendicular to said rotation axis. In one embodiment, each of said plurality of micropatches includes a multilayer patch.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore nonlimiting, embodiments illustrated in the drawings accompanying and forming a part of this specification, wherein like reference numerals designate the same elements in the several views, and in which.

DESCRIPTION OF PREFERRED EMBODIMENTS

The present invention and the various features and advantageous details thereof are explained more fully with reference to the nonlimiting embodiments that are illustrated in the accompanying drawings and detailed in the following description. Descriptions of well known components and processing techniques are omitted so as to not unnecessarily obscure the present invention in detail.

The above-mentioned requirements of high scan rate and inexpensive apparatus are mutually contradicting and cannot be satisfied simultaneously in the case of either traditional gimbal dish antenna installation or phased array antennas. However, it is rendered possible to simultaneously satisfy these requirements to a certain extent by employing an evanescent coupling antenna according to the present invention in consideration of the fact that a waveguide assembly can be made to independently rotate coaxially with regard to a rotating disk grating pattern so as to provide two to dimensional scanning.

Figure 1:
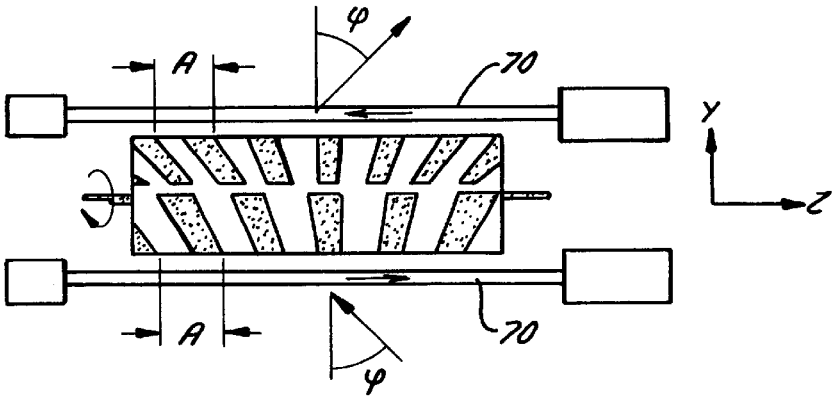
FIG. 1 illustrates a schematic elevational view of a 1-D scanning rotating drum evanescent coupling antenna.

Referring to FIG. 1, the spinning drum antenna disclosed in U.S. Ser. No. 08/382,493 is a bistatic antenna that provides 1-D scanning and is the foundation for the present invention. Beam tracing in the y-z plane is represented by the diagonal single headed arrows. The angle $\phi$ of emission, and reception, are determined by the instantaneous value of the grating period $\Lambda$ nearest the waveguides 70. The grating period varies along the circumference of the drum, thereby providing scanning in one dimension as the drum rotates.

In common with the rotating drum approach, the present invention is based on the phenomenon of evanescent wave coupling and involves the interaction of guided waves with a periodic perturbation, resulting in directionally selective coupling of MMW energy into, and/or out-of, a waveguide. Such an antenna is inexpensive, easy to fabricate and easily adapted to mass production.

In contrast to the rotating drum approach, the present invention is based on a rotating disc geometry, with a coaxial superimposed rotating waveguide geometry, thus providing 2-D scanning together with a physical configuration that is much more compact than that of the spinning drum geometry. This principle of coaxial operation leads to various practical implementations suitable for remote sensing and for communications.

The present invention will greatly benefit vehicle collision avoidance systems, autonomous landing radars and MMW imaging cameras used for industrial inspection and concealed weapon detection. The present invention combines small volume and light weight in an affordable package. Although the following description is primarily directed to a passive MMW system, the imaging antenna, and its underlying principles, work for active systems, and for other wavelengths, as well.

Figure 2:
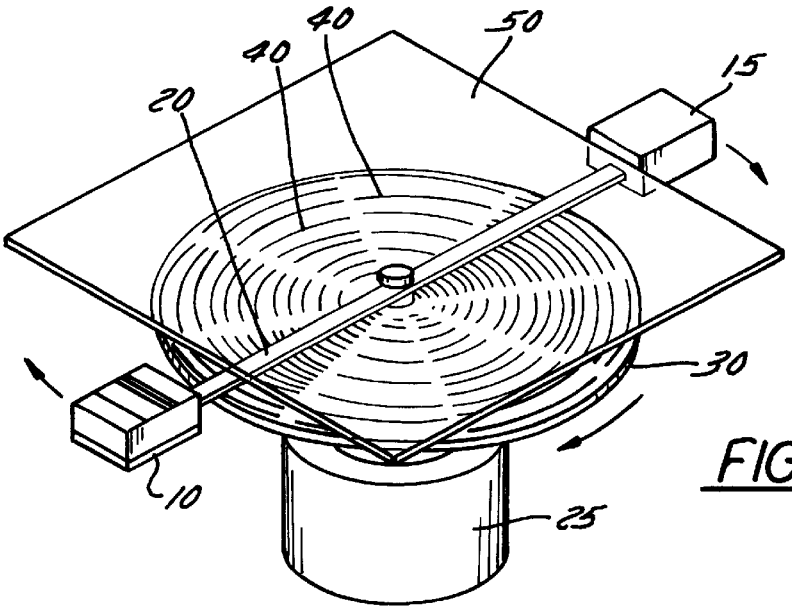
FIG. 2 illustrates a perspective view of a rotating 2-D scanning rotating disk evanescent coupling antenna according to the present invention.

Referring now to FIG. 2, an embodiment of the present invention will be described. A receiver 10 is connected to a single mode dielectric waveguide 20. Terminator 15 is connected to the other end of single mode dielectric waveguide 20. Receiver 10, terminator 15 and waveguide 20, together with the spindle attachment to which they are mounted, compose a waveguide assembly which can be driven clockwise in the direction of the paired arrows at a relatively slow velocity, (e.g., from approximately 10 rpm to approximately 600 rpm), by a drive assembly, (not shown). A rotating disk 30 is divided into a number of sectors 40, (not all of which are labeled), each opposing sector pair carrying an identical grating. The periods of the gratings vary along the circumference of the circle. The spacings between separated strips of the gratings determine the grating parameter $\Lambda$ and the scanning angle $\phi$ of the antenna. Rotating disk 30 together with the fixture upon which it is mounted compose a grating assembly. Rotating disk 30 is driven clockwise in the direction of the single arrow at a relatively (with regard to the waveguide assembly) high velocity, (e.g., from approximately 360 to approximately 21,600 rpm), by a drive motor assembly, (not shown). Both the waveguide assembly and the grating assembly are connected to platform 25. When a grating with a particular period is behind the waveguide 20, and in close proximity to the waveguide 20, the waveguide aperture becomes angularly selective, so that only radiation coming from, or going to, a particular angle, $\phi$ (in a plane that contains the longitudinal axis of the waveguide 20 and which is normal to the plane of the disk 30) will be coupled into, or out-of, the waveguide 20. The angle $\phi$ is determined by the grating period $\Lambda$ through the formula $$\phi=\arcsin(N_{eff}-m\lambda/\Lambda) \quad (1)$$

where $N_{eff}$ is the effective refractive index of the waveguide for the fundamental mode, m is an integer defining the diffraction mode, and $\lambda$ is the wavelength of the electromagnetic radiation in vacuum. As the rotating disk 30 rotates, gratings with incrementally changing periods come into close proximity with the waveguide 20 and a linear scan can be provided with regard to the plane that is normal to the disc 30 and parallel to the longitudinal axis of the waveguide.

In the direction perpendicular to the scan, the beam pattern can be formed by a cylindrical lens 50. Cylindrical lens 50 can be a Fresnel lens or a zone plate to make the antenna lightweight and compact. The scanning achieved by the fast rotation of disk 30 is in the radial direction, (i.e., parallel to the waveguide 20).

For complete two-dimensional (2-D) imaging, an azimuthal, or circular, scan is provided by the relatively slow rotation of the waveguide 20 and the cylindrical lens 50 around an axis that can be coaxial with that of the rotating disc 30. The slowly rotating waveguide assembly can also include a two stage receiver, an LNA and an amplifier of the detected signal (none of which are shown in FIG. 2). The signal is then transmitted from the rotating waveguide assembly by the use of an optical link, (also not shown).

Figure 3:
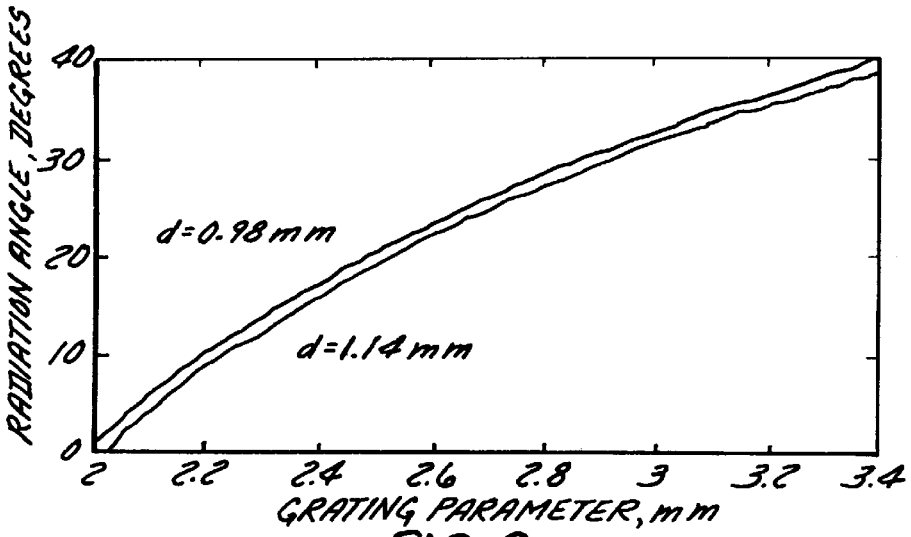
FIG. 3 illustrates scanning angle as a function of grating period for two waveguides, (of different diameters), according to the present invention.

Referring now to FIG. 3, as an example, a scan angle, extending to 40 degrees, is shown as a function of the grating period for two dielectric rod waveguides with different diameters. The upper curve is for a waveguide with a diameter of 0.98 mm. Similarly, the lower curve is for a waveguide with a diameter of 1.14 mm. The difference in radiation angle for the two waveguides is due to the fact that the thinner waveguide has a higher effective refractive index. FIG. 3 illustrates scanning angle versus grating period for a 94.3 GHz antenna with a quartz dielectric waveguide, $\in=3.78$.

As noted above, one dimension of the two-dimensional scanning takes place along the waveguide due to a rapid change in the grating parameter from the high speed rotating disk. The grating sectors on the rotating disk can be designed so that one complete rotation of the rotating disk provides a complete one-dimensional scan for that position of the waveguide. Alternatively, the grating sectors can be designed to provide multiple linear scan for every complete rotation of the disk.

As the waveguide assembly slowly rotates, (e.g., one or a few degrees), the high speed rotating disk spins much more quickly and carries out the linear scan pattern. The waveguide assembly then slowly rotates a little more and the scanning pattern driven by the rotating disk is repeated for that position of the waveguide assembly. Eventually, the waveguide assembly completes one full rotation with regard to the spindle assembly.

Figure 4A:
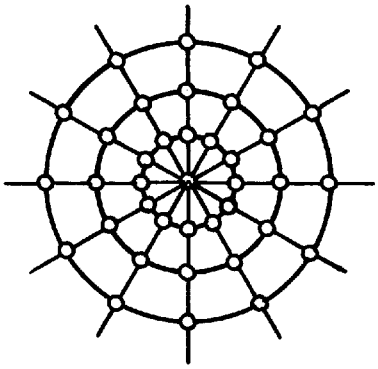
FIG. 4*a* illustrates a polar physical display according to the present invention.
Figure 4B:
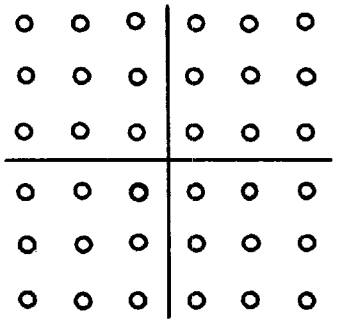
FIG. 4*b* illustrates a Cartesian physical display according to the present invention.

The image obtained as the result of the just described scanning is in polar coordinates. FIG. 4(*a*) is an illustration of the polar display arising from the 2-D antenna scan. The polar coordinates can be transformed, into Cartesian coordinates. FIG. 4(*b*) is an illustration of the Cartesian display obtained after transformation.

As will be discussed in more detail below, the data from sequential scans is used to obtain the Cartesian space shown in FIG. 4(*b*). A given linear scan can be referred to as collecting a first set of polar coordinate data while a subsequent linear scan can be referred to as collecting a second set of polar coordinate data. In a preferred embodiment, these two sets of polar coordinates are used as the basis for performing a set of coordinate transformations.

By comparing either polar or Cartesian coordinate data sets, it can be determined whether a threshold has been exceeded. If such a threshold has been exceeded a physical display can be transformed yielding a concrete effect from the transformation of sampling data that represents the spatial relationship of real-world objects that have just been imaged by radar.

Combined with a W-band millimeter integrated circuit (MMIC) direct detection receiver, the disclosed imaging antenna offers numerous benefits. One benefit is full control of a beam shape through a flexible design of the grating pattern. Another benefit is fast 2-D scanning. Another benefit is the use of a single detector which can be made to exhibit superior performance. Another benefit is a compact, lightweight design. Yet another benefit is the ability to obtain inexpensive fabrication through photolithography, thereby indicating that the invention is suitable for mass production. Gain and equivalent noise temperature are relatively easy to control in the present invention. The spinning grating antenna provides excellent performance while being very fast and cost effective.

Figure 5:
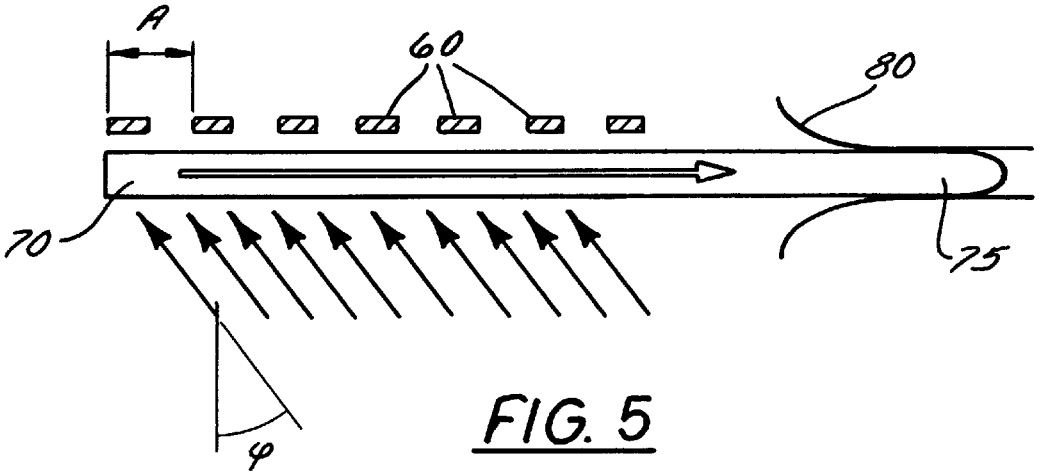
FIG. 5 illustrates a schematic cross sectional view of electromagnetic radiation being received by a waveguide according to the present invention.

Referring to FIG. 5, a metal grating is shown perturbing the evanescent waves near a waveguide. Metal grating 60 is located near dielectric waveguide 70. Millimeter wave electromagnetic energy is incident upon dielectric waveguide 70. The incident energy is coupled into dielectric waveguide 70 along a direction represented by the single long arrow. The field 75 inside the waveguide 70 is coupled to the evanescent field 80 outside the waveguide. The interaction between metal grating 60 and evanescent field 80 determines the angle $\theta$ as a function of $\lambda$, $N_{eff}$ and $\Lambda$.

The MMW energy feed for the proposed antenna can also be a dielectric waveguide, such as silica or polytetrafluoroethylene. The unique feature of a dielectric waveguide is that it supports propagation of electromagnetic waves inside its bulk as well as along the outside. The evanescent waves (the waves immediately outside the waveguide body) can easily be perturbed by the presence of a conducting grating. The result of this interaction is selective coupling of radiation into or out of the waveguide. The waveguide propagation mode is excited only by radiation coming from a particular angle $\phi$, defined by Equation (1), or if the propagation constant $\beta$ is used, when $$\sin\phi=\beta/k_o-m\lambda/\Lambda \quad (2)$$

where $k_o=2\pi/\lambda$.

In the present invention, the perturbing grating is imposed onto the flat surface of a rotating disc. This grating can be fabricated in at least two ways. It can be formed as an entirely metal grating with the pattern formed as a deep profile, or it can be formed as a thin metal grating of separated metal strips on a dielectric substrate. In the latter case it can be fabricated using mature printed circuit board technology such as photolithography, including wet etching of the metal.

Figure 6:
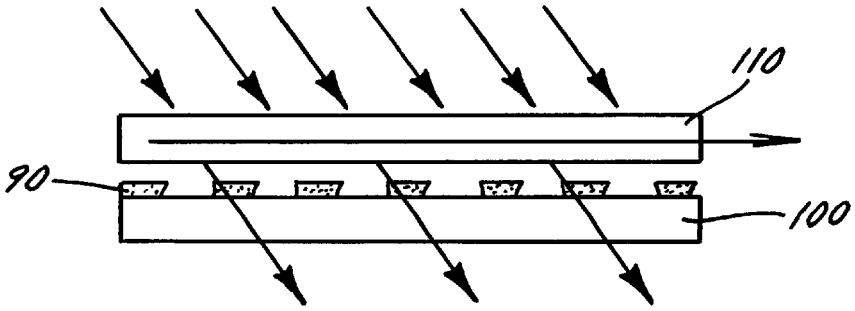
FIG. 6 illustrates a schematic cross sectional view of an imaging antenna receiving electromagnetic radiation according to the present invention.

Referring to FIG. 6, thin metal grating 90 is formed on dielectric substrate 100. Thin metal grating 90 and dielectric substrate 100 compose a grating assembly. Incident millimeter wave electromagnetic energy is shown as six parallel arrows incident dielectric waveguide 110. If the period $\Lambda$ of the thin metal grating 90 corresponds to the incident angle, much of the incident energy will be coupled into dielectric waveguide 110. However, as is the case with any other type of grating, a metal grating located on a dielectric substrate will not couple all of the incident radiation into the waveguide. A portion of the incident radiation will simply pass through dielectric substrate 100. This lost energy is depicted in FIG. 6 as the three parallel arrows at the bottom of the illustration.

Figure 7:
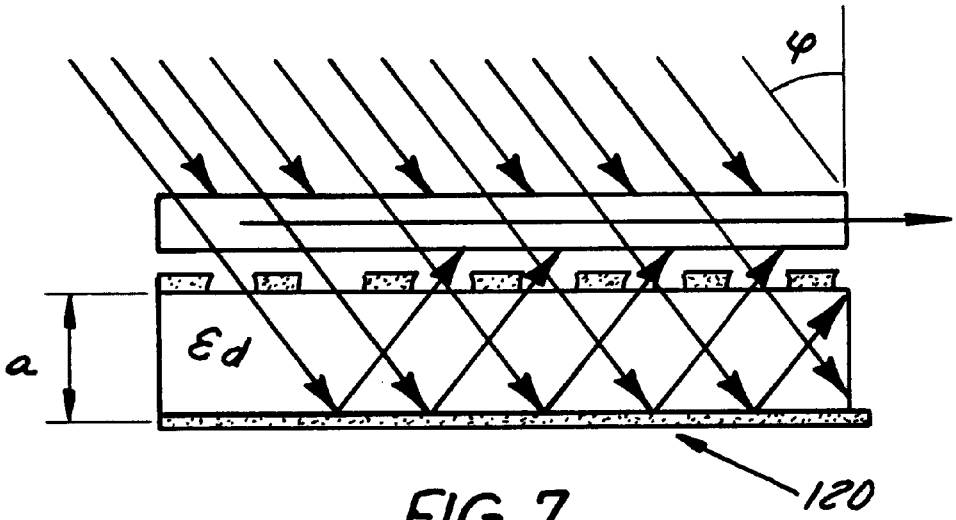
FIG. 7 illustrates a schematic cross sectional view of an imaging antenna, with a reflecting layer, receiving electromagnetic radiation according to the present invention.

Referring to FIG. 7, much of any "lost" radiation can be redirected into the waveguide if a reflecting layer 120 is provided on the other side of the dielectric substrate to make the interference between the "lost" MMW beam and the redirected beam constructive. In this embodiment, the thickness of the dielectric layer a must be chosen based on the condition $$a=\lambda \cos \phi/(4\in_d^{1/2}) \tag{3}$$

where $\phi$ is the center of the angular scanning range, $\lambda$ is the wavelength of interest and $\in_d$ is the dielectric constant of the grating substrate material.

Figure 8:
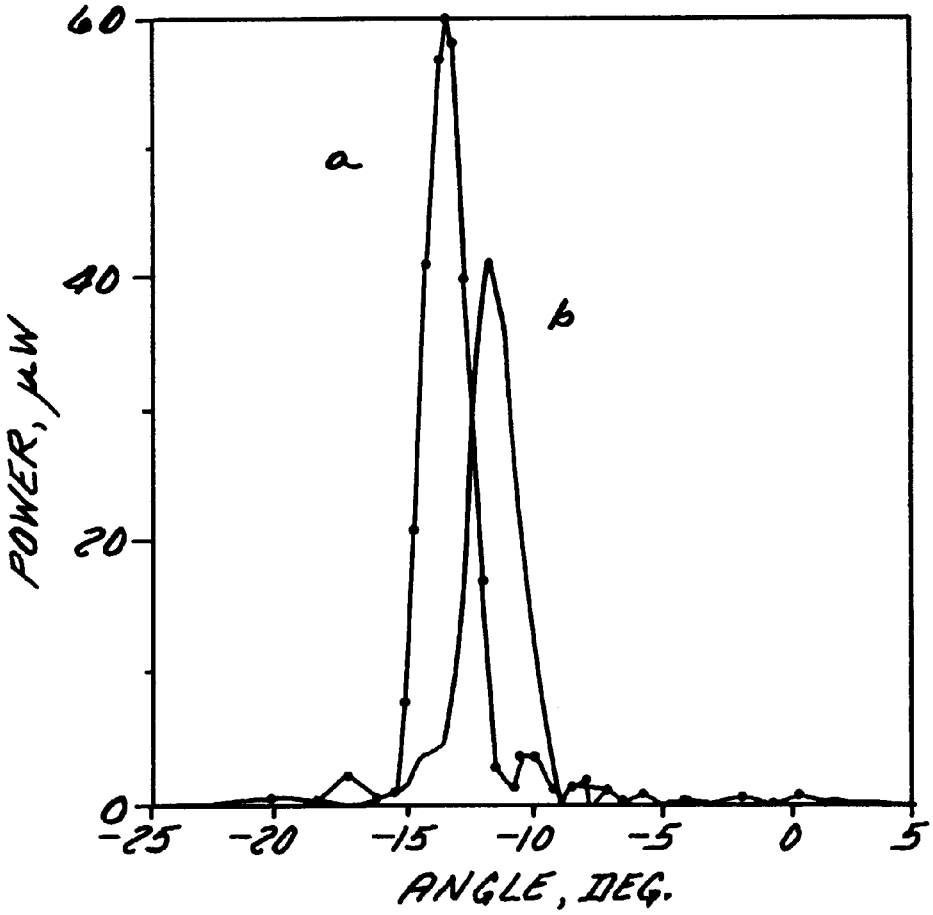
FIG. 8 illustrates transmitted power as a function of scanning angle for two different grating assemblies, (of the same grating parameter), according to the present invention.

Referring to FIG. 8, the efficiency of the two types of gratings (FIGS. 6 and 7) is compared. Curve "a" shows a beam pattern for a grating assembly with a back-reflector. Curve "b" shows a beam pattern for a similar grating assembly without the reflector. For both of the grating assemblies, $\Lambda$=2.3 mm. The observed angular shift indicates the effect of the metal layer as its presence alters the propagation constant of the dielectric waveguide.

The dependence of $\phi$ on $\Lambda$, described by Equation (1), forms the basis for the scanning capability. Referring again to FIG. 2, and assuming that the grating strips are long enough compared to the waveguide diameter, due to the fast decay of the evanescent waves with distance from the waveguide, only the particular grating in close proximity to the waveguide will couple the incident electromagnetic waves into the waveguide. Then, by moving to the next grating sector (that is, by rotating the disc), a different grating period is brought into the proximity of the waveguide. This, in turn, changes the angle $\phi$, thereby scanning the beam in a plane (the H-plane).

The advantage of the spinning grating is that it avoids the periodic mechanical accelerations, typical of an oscillating body, which severely restrict scanning capability. The spinning grating allows improvement of the scanning speed by orders of magnitude. A simple estimate for a system operating at a frequency of 94 GHz, with a disc diameter of 10" and a disc rotation speed of 3,000 rpm, gives a scanning rate of 15,000 positions per second. Of course, this is not an upper limit. At a higher rotation speed, and with a larger disc diameter, scanning rates can be even higher.

The desired two-dimensional image of the system will be formed by combining the line (radial) scanning with circular (azimuthal) scanning. The line scanning must be relatively fast, while the circular scanning can be much slower. Very fast H-plane beam-scanning is an excellent candidate for providing radial scanning.

Figure 9:
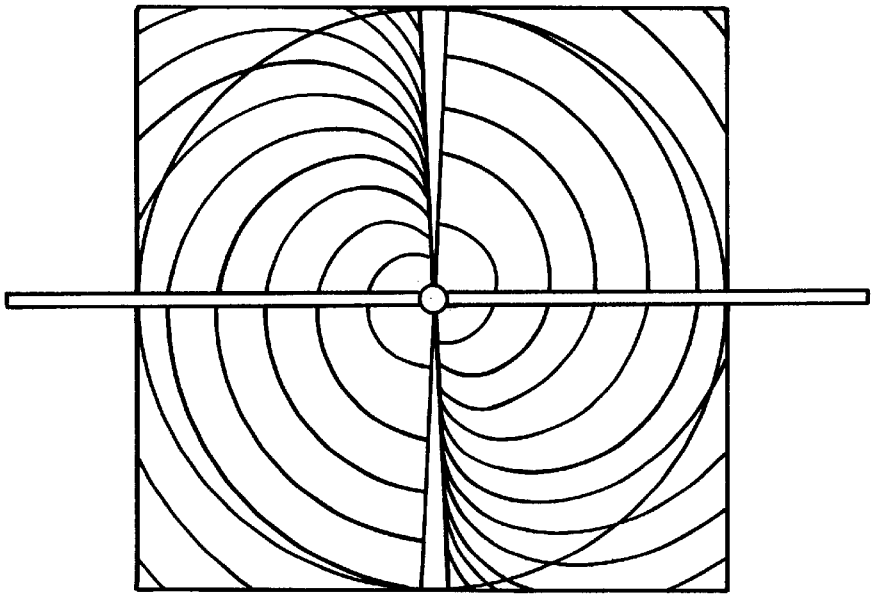
FIG. 9 illustrates a schematic elevational view of a grating assembly and a waveguide assembly according to the present invention.

Additional advantages of the proposed technique including the following. Linear or any other pattern of beam scanning can be used. Scanning can be either in one direction or back and forth. The beam returns quickly to its initial position after completing a scanning cycle. The design supports both digital (discrete) and continuous scanning modes through the use of digitally varying or continuously varying grating patterns. A digitally varying grating is shown in FIG. 2. Continuously varying gratings are shown in FIGS. 1 and 9. A steppingly varying grating is merely a grating where a continuous varying grating is repeated.

The grating can be fabricated using printed circuit board technology, (i.e., photolithography). Design of a grating pattern using computer aided design (CAD) will permit the creation of a master photolithographic mask and fabrication of the grating on a substrate. The materials to be used can be copper plated duroid.

A judicious design of the grating will result in high antenna gain and low sidelobes. For any particular position of the waveguide, the underlying grating has a constant period which varies continuously as the disc rotates.

The grating pattern $R(\alpha)$ can be described in polar coordinates R, $\alpha$ by the following expression $$R(\alpha)=R_o+m\alpha_o^{\rho}T, \text{ for } \alpha_o\leq\pi;\ R_o+m(\alpha_o-\pi)^{\rho}, \text{ for } \alpha_o>\pi \tag{4}$$

where m is the ring number, $\alpha_o$=mod($\alpha$,2$\pi$), T represents the smallest grating period, and the positive number $\rho$ determines how fast the grating period changes with the rotation; $R_o$ is the radius of a small circle at the center needed for the antenna support structure. To optimize the antenna performance, the grating may have to have a radically non-uniform period and the width of the metal strips may have to vary as well.

Figure 10A:
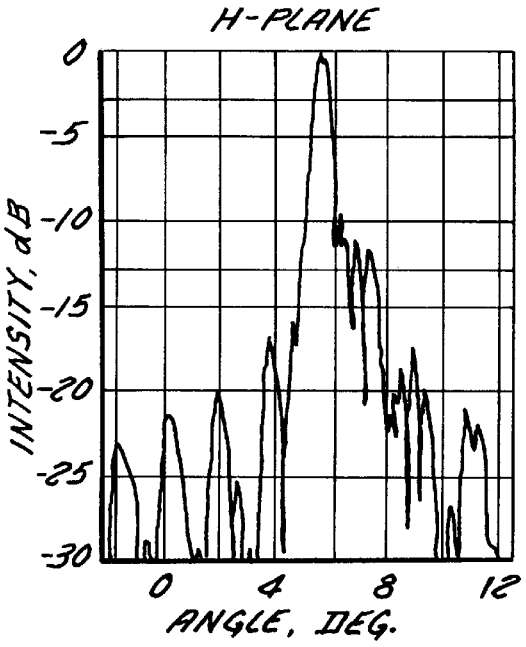
FIG. 10*a* illustrates transmitted intensity as a function of scanning angle for a first conductive grating pattern according to the present invention.
Figure 10B:
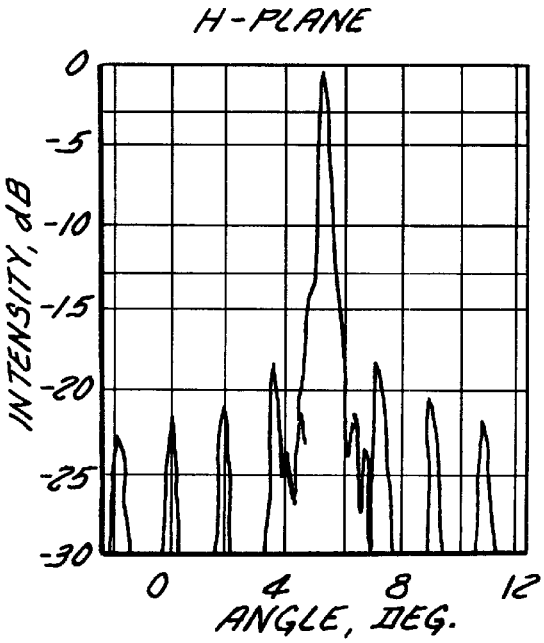
FIG. 10*b* illustrates transmitted intensity as a function of angle for a second conductive grating pattern according to the present invention.

Referring to FIGS. 10(*a*)–10(*b*) a comparison of far-field performance different grating patterns is shown. FIG. 10(*a*) illustrates performance from a simple grating. FIG. 10(*b*) illustrates an unexpected advantageous result once a non-uniform line width was introduced. Specifically, FIG. 10(*b*) shows the reduction of sidelobes achieved by varying the width of the grating line along the diameter.

In order to properly design the system's dielectric waveguide and the diffracting disk so that the beam can be accepted from the desired directions, the effects associated with the electromagnetic coupling between the waveguide and the disk should be understood qualitatively as well as quantitatively. More specifically, the wave's complex phase velocity (real and imaginary parts) in the waveguide, and in the presence of the grating, is a function of the various grating parameters. The system can be designed to leak the electromagnetic energy at the proper dB/length rate while simultaneously phasing the radiated wave in the appropriate direction.

Due to the complexity of the geometry involved (a metallic grating resting on a dielectric substrate, near a dielectric waveguide), the problem can be solved using a suitable rigorous (in a numerical sense) electromagnetic analysis technique. The finite-element method can be used to rigorously solve Maxwell's equations subject to the boundaries and electromagnetic parameters of the pertinent antenna configuration. The advantage of this approach is its generality. However, this advantage comes at the expense of the need for large computational resources, particularly to meet convergence difficulties for the elements near the edges of the grating metal strips (caused by the intense and fast-varying electric field present).

If the complete length of the grating cannot be modeled with the available computer resources, then only a few periods of the grating with its corresponding waveguide section need to be modeled. This will be sufficiently accurate to provide the electromagnetic field distribution near the surface. Using this field, the field over the whole length of the grating can be approximated analytically by appropriate repetition and phasing of the limited field. Finally, from this approximated field, radiation patterns for the whole length of the grating can be obtained using the equivalence principle.

By repetition of the above procedure, a parametric study of the electromagnetic characteristics of the configuration can be conducted. Design curves can be used to define preferred embodiments of the system and to optimize their performance.

As noted above, the rotating grating structure imposed on the disc will provide the radial scan. As also noted above, in order to achieve two-dimensional imaging, a circular (angular) scan must be added. This is accomplished in the proposed system by rotating the waveguide, along with the cylindrical lens, around the same axis as the disc, but at a much slower speed of rotation. Thus, two rotations will take place simultaneously, however, with different angular velocities.

Figure 11:
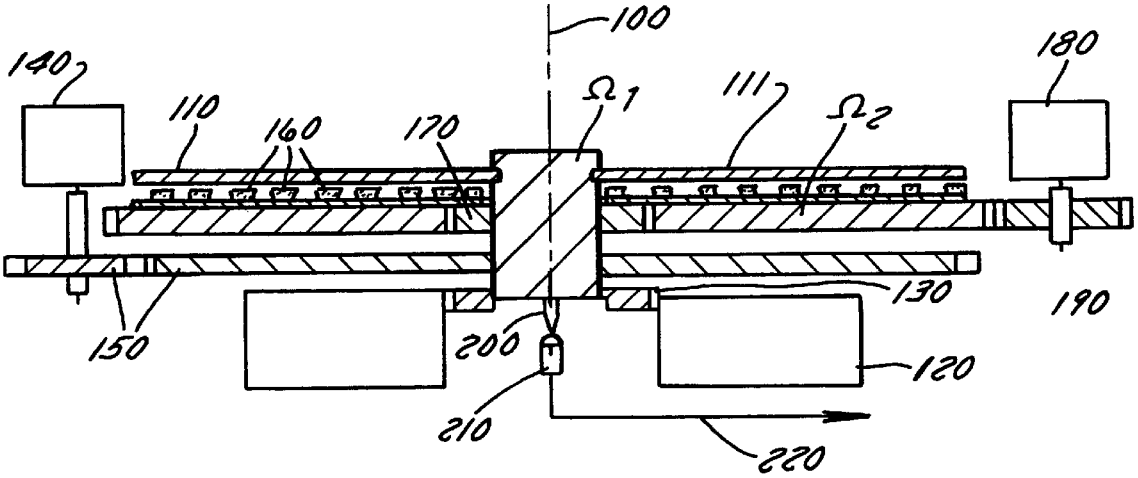
FIG. 11 illustrates a schematic partial cross sectional view of an imaging antenna according to the present invention.

Referring to FIG. 11, the ratio of the disc's angular velocity $\Omega_2$ to that of the waveguide, $\Omega_1$ determines the number of radial scanning lines in the image and is equivalent to the number of lines in a standard raster scan image. Waveguides 110 and 111 rotate around rotation axis 100. In the illustrated example, the waveguide assembly is attached to stationary platform 120 and rotates by means of bearing set 130. The waveguide assembly is driven by motor 140 through gears 150. Grating 160 rotates about rotation axis 100 by means of bearing set 170. The grating assembly is driven by motor 180 through gears 190.

FIG. 11 also shows a way to transmit signals from the waveguide assembly to a signal processing and a display unit. A diode laser (DL) 200 is located on-axis and is modulated by a rectified low-frequency signal and used as a transmitter. Electromagnetic signals are conveyed between diode laser 200 and photodiode 210 resulting in output 220. It should be noted that the cylindrical lens is not shown in FIG. 11.

Two primary issues associated with dual rotation are: the design of the mechanical assembly and the signal transmission. FIG. 11 shows only one of many possible ways to effect independent rotation of the grating disc and the waveguide assembly. In fact, a single motor can be used to drive both the waveguide assembly and the disc through gears or a tension guide.

Figure 12:
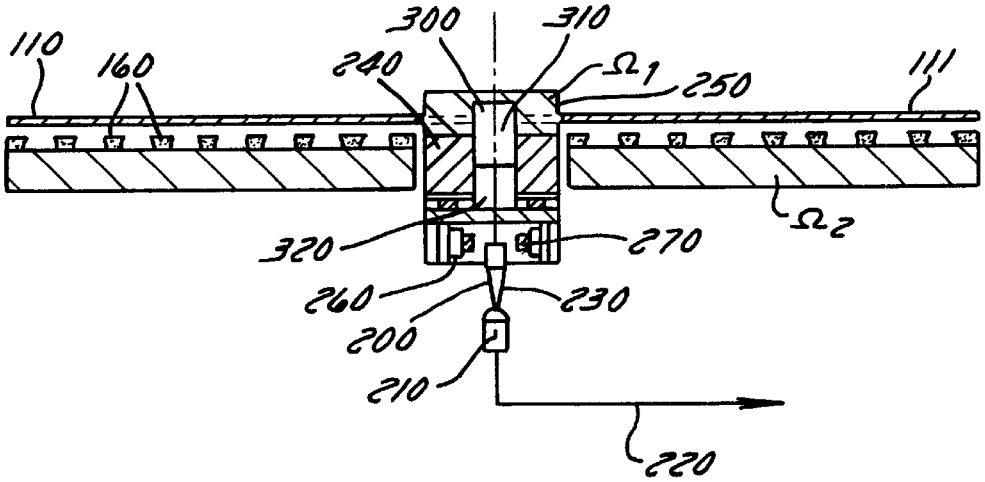
FIG. 12 illustrates a schematic cross sectional view of a portion of the imaging antenna shown in FIG. 11.

Referring to FIG. 12, an optical link 230 is illustrated. FIG. 12 shows how a laser-diode/photo-diode link can be used for a non-contact signal transmission from the rotating assembly. Battery 240 is located in spindle assembly 250. T-coupler 300 combines the millimeter wave power from the two arms of the waveguide 110 and directs it into detector 310. The signals then travel to filter and preamplifier 320. Spindle assembly 250 also includes an amplifier integrated circuit 260 and a buffer integrated circuit 270. Eventually, the detected and amplified signals are emitted by diode laser 200. In the illustrated embodiment, two waveguide modes propagate toward each other, so that the grating does not have the axial symmetry shown in FIG. 9. Instead, a mirror symmetry is required. This symmetry is discussed below in more detail with reference to FIG. 15.

To characterize performance, a scanning antenna test can be performed separately in a transmission mode using near-field measurements. Near-field measurements offer a fast and accurate method of identifying preferred embodiments of the invention without undue experimentation by determining antenna gain, polarization purity, beam pointing, and other parameters of interest. The advantages of near-field measurements include high accuracy, high data rate, a complete characterization of antenna performance, and elimination of delays related to the outdoor range testing. The following information can also be obtained from near-field measurements: far-field pattern, beamwidth, reflector surface distortion and sidelobe levels.

In general, a MMW receiver can be implemented either as a direct amplification device or as a super heterodyne receiver. In the case of a direct receiver, selectivity is determined by an MMW filter, so that many sections may be required. Further, direct amplification may also require stable low noise transistors operating at approximately 94 GHz.

A super heterodyne receiver can be used, since MMW radiometers based on super heterodyne receivers have already demonstrated good sensitivity. Recently developed 94 GHz direct detection receivers are suitable. Such super heterodyne receivers are commercially available from Millitech Corporation and Epsilon Lambda Corporation.

Upon selection of the receiver, the waveguide assembly design can then be developed. A quartz cylindrical waveguide can be used in conjunction with a transition to a metal waveguide.

An optional radio frequency (RF) preamplifier can be based on high electron mobility transistor (HEMPT) amplifiers. Because the present invention can be based on a single-channel receiver, a higher cost HEMPT amplifier with an outstanding noise factor can be used without an undue increase in cost.

The super heterodyne receiver can operate in double sideband (DSB) mode. The main amplification, 60 dB to 80 dB, can be accomplished at an intermediate frequency (IF). Depending on the architecture selected, the receiver will be designed either as a single unit or with a wireless link between sections.

High gain can create DC amplifier instability, but a Dicke switching scheme is an effective means of overcoming this problem. The metal grating used for H-plane scanning can have a gap in the grating pattern. Each rotation cycle of the disc brings the gap into proximity with the dielectric waveguide. At that moment the sensor output is proportional to the system internal noise rather than the sum of the useful signal and system noise. Therefore, the bias caused by the noise can be measured and subtracted from the output signal, applying essentially the same principle as used in the Dicke radiometer.

After amplification, integration and conditioning, the signal from the sensor can undergo image signal processing. An advantage of the single channel architecture is that it allows the use of the highly developed TV receiver technology for image signal processing. To produce the output image, the H- and E-plane beam-scanning can be synchronized with the corresponding line and frame image-scanning.

The following parameters of the system will drive the design process: the number of resolved positions per scan, beamwidth, aperture size, field of view, antenna length, RF bandwidth, IF bandwidth, IF noise factor, IF gain, frequency and power of the local oscillator, integration time, and object temperature resolution.

The present invention may require polar-to-Cartesian coordinate transformation. There are several methods to accomplish this.

Figure 13:
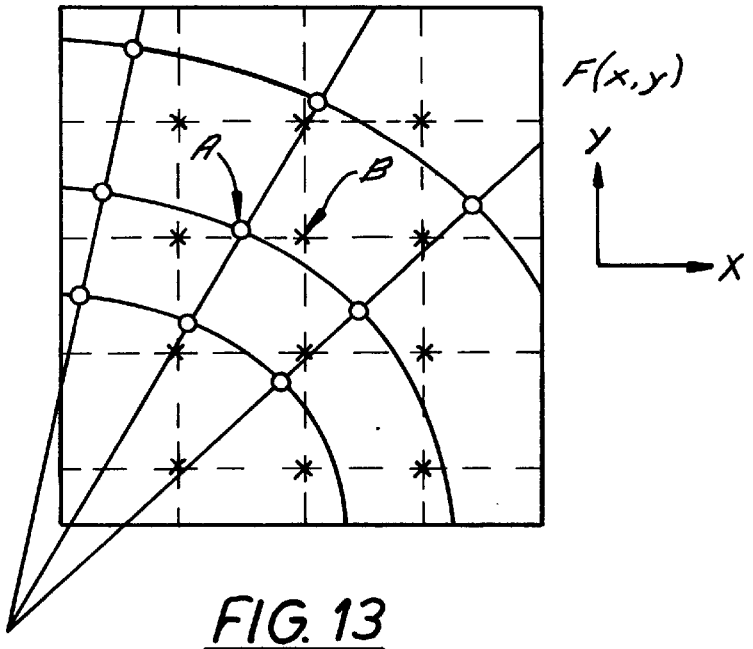
FIG. 13 illustrates a transformation technique from polar to Cartesian coordinates according to the present invention.

Referring to FIG. 13, in a simple approach, for every Cartesian sample (for example, point B) the nearest polar sample can be considered (point A). FIG. 13 shows the co-location of polar samples ("o") and Cartesian samples ("x"). This method assumes that the image is piece wise constant, hence the approximation is rough but computationally very fast.

Figure 14:
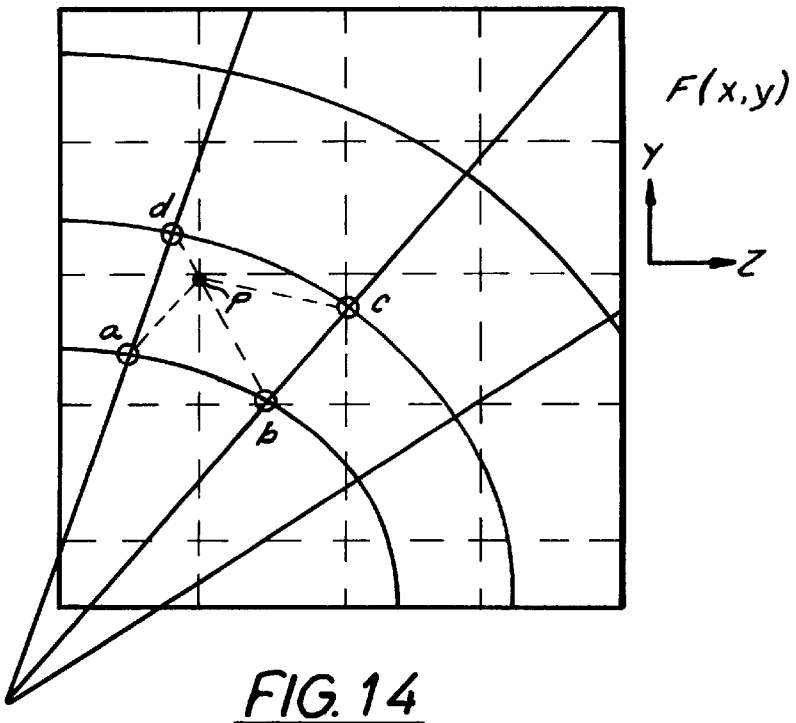
FIG. 14 illustrates a transformation technique from polar to Cartesian coordinates based on linear interpolation using four nearest neighbors according to the present invention.

Referring to FIG. 14, polar-to-Cartesian coordinate transformation based on linear interpolation using four nearest neighbors is shown. This is an improved version where the value at point p in Cartesian coordinates is approximated by a weighted sum of its four nearest polar neighbors a, b, c and d according to a relationship.

$$F(p) = \frac{(1/l_a)F(a) + (1/l_b)F(b) + (1/l_c)F(c) + (1/l_d)F(d)}{1/l_a + 1/l_b + 1/l_c + 1/l_d} \quad (5)$$

where $l_i$=a,b,c,d are respective distances from the polar samples to p, and F(. . . ) is the value at the sampling point, F(p)=F(x,y) at p.

In addition, non-linear approximation using polynomials can be used where, using the mean square estimate method, one can derive a system of linear equations to determine unknown coefficients of the polynomials. In particular, Zernike polynomials allow orthogonalization along radii so that the system can be solved with minimum computing.

Figure 15:
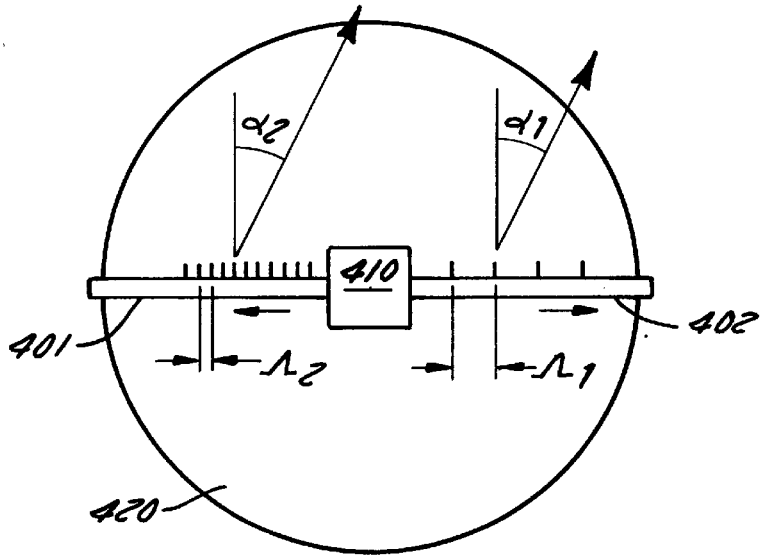
FIG. 15 illustrates a schematic elevational view of an imaging antenna according to the present invention.

Referring to FIG. 15, an antenna according to the present invention is shown operating in transmission mode. Waveguide 401 is connected to spindle assembly 410. Similarly, waveguide 402 is connected to spindle assembly 410. The longitudinal axis of waveguide 401 is substantially parallel to the longitudinal axis of waveguide 402. The grating period beneath waveguide 401, $\Lambda_2$ is complementary, but not equal to, the grating period beneath waveguide 402, $\Lambda_1$. Both of the waveguides can be simultaneously run in transmission, as shown, or in a receiver mode, or one of the waveguides can be run in transmission mode while the other waveguide is run in receiver mode.

For this embodiment the scanning angles are defined as $$\alpha = \arcsin\,(N_{eff} \pm p(\lambda/\Lambda)) \quad (6)$$

where p=±1, ±2, . . . For example, where p=±1, the scanning angle for the grating period $\Lambda_1$ will be $$\alpha_1 = \arcsin\,(N_{eff} + \lambda/\Lambda_1) \quad (7)$$

and the scanning angle for the grating period $\Lambda_2$ will be $$\alpha_2 = \arcsin\,(N_{eff} - \lambda/\Lambda_2) \quad (8)$$

Figure 16:
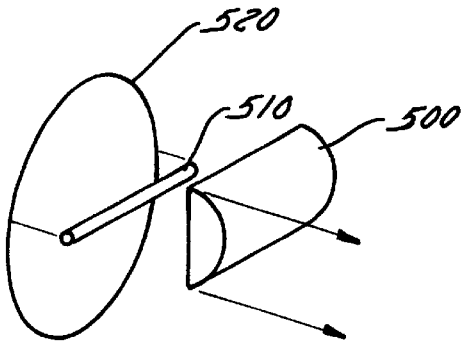
FIG. 16 illustrates a schematic perspective view of a grating assembly and a waveguide assembly, (with cylindrical lens), according to the present invention.

Referring to FIG. 16, a cylindrical lens 500 is shown located above waveguide 510. Cylindrical lens 500 and waveguide 510 compose a waveguide assembly. The waveguide assembly rotates about grating assembly 520.

Figure 17:
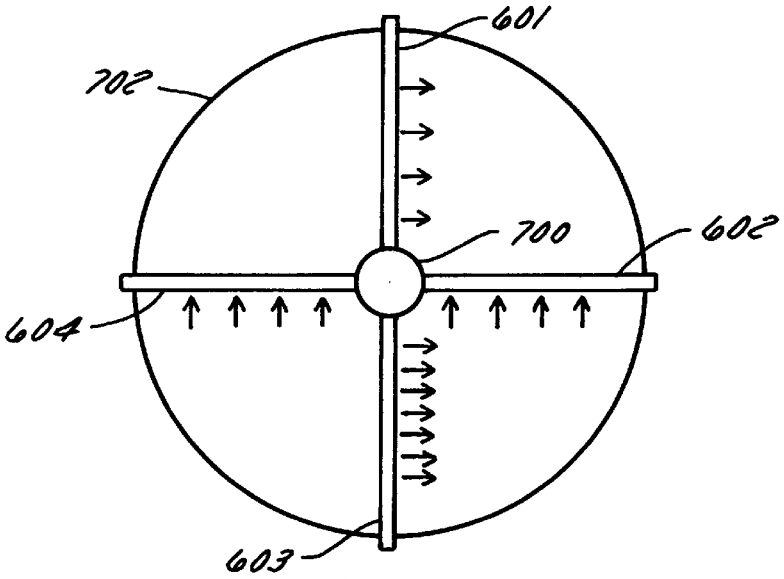
FIG. 17 illustrates a schematic elevational view of an imaging antenna according to the present invention.

Referring to FIG. 17, an embodiment of the antenna according to the present invention that is well suited for use as a seeker is shown. First waveguide 601 is connected to spindle assembly 700. Similarly, dielectric waveguides 602, 603 and 604 are all connected to spindle assembly 700. The grating assembly 800 therefore must include gratings for each of the mirrored pair of waveguides. If the number of targets n is equal to 1, there will be one image. If the number of targets, n, is greater than or equal to two, there will be $n^2-n$ false images. However, by using a variable position, (rotating) waveguide assembly, the false images can be culled out because their apparent position will vary as a function of the waveguide angle.

The grating pattern directly determines the antenna performance. In order to optimize antenna beamwidth, sidelobes and gain, the effects of grating parameters such as the period, the line width, the line tilt and the grating distance on the antenna performance can all be optimized one at a time without undue experimentation.

As previously noted, traditional mechanically scanning antennas have the disadvantage of inertia that must be overcome at the beginning and end of each scan. This inertia dramatically limits the use of gimbaled antennas for applications where a rapid two-dimensional scan is required (as is the case for the concealed weapons detection system). Electronically scanned antennas are fast but are prohibitively expensive at MMW frequencies. Cost is also an issue with MMW focal plane arrays. Focal plane array systems are difficult to fabricate, requiring large numbers of densely packaged receivers, along with a distributed readout network (essentially one receiver per pixel). This focal plane array approach is expensive due to the large number of parts that are required and the corresponding packaging problems. Clearly, utilizing fewer receivers that are packaged in a more sparse configuration, while maintaining overall system performance, would greatly reduce system cost.

In general, presently pursued MMW systems for concealed weapons detection can be classified according to the characteristics shown in Table 1.

TABLE 1

Presently pursued MMW system concepts for Concealed Weapons Detection

| System Type | Imaging Depth of Field | Computational Requirements | Potential for Low Cost | Potential for Portability |
|---|---|---|---|---|
| Focal Plane Array | Small | Low, except for post processing | Unclear | Promising |
| Holographic/ SAR | Large | High | Unlikely | Very little |

The present invention addresses the major concerns outlined in Table 1. The present invention can use only N receivers (transceivers for the active mode) to achieve the $N^2$ resolution points provided in an equivalent focal plane array. In addition, by design, the receivers can be sparsely distributed on the circumference of a circle which greatly simplifies fabrication and assembly. This embodiment of the present invention combines the features of a microstrip patch array and a lens antenna system. Scanning is attained through a unique waveguide feed as shown in FIG. 18.

Figure 18:
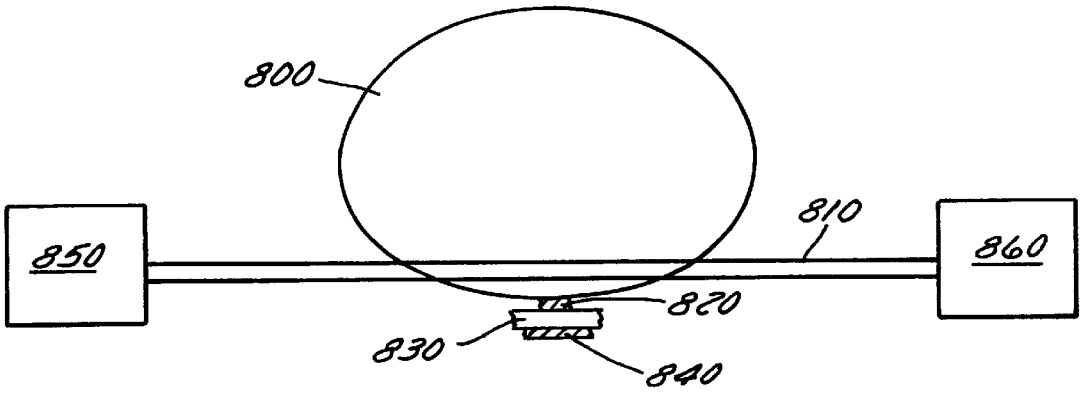
FIG. 18 illustrates a schematic view of an omnidirectional beam pattern formed by a microstrip patch fed through a dielectric waveguide according to the present invention.

Referring to FIG. 18, beaming pattern 800 is produced by the interaction between the evanescent wave produced by electromagnetic energy within dielectric waveguide 810 and the diffraction grating composed by microstrip patch 820. Microstrip patch 820 can be coated on substrate 830. Ground plane 840 can be provided on the opposite side of substrate 830 to act as a reflector, as previously discussed. Transceiver 850 is connected to a first end of dielectric waveguide 810. Load 860 includes a millimeter wavelength absorbing material and is connected to a second end of dielectric waveguide 810.

This feed concept has proven to be very efficient and is characterized by low losses since the dielectric waveguide supports only the principal propagation mode. The evanescent tail of the principal mode propagates outside the waveguide and generates current in the adjacent patch.

In contrast to the microstrip array, a single microstrip patch, (or cluster of patches), will generate a well controlled, broad to omnidirectional beam and is analogous to an optical point source. This approach forms the basis for a two-dimensional imaging antenna that meets the requirements of a remote frisk system for concealed weapons detection. The remote frisk concept is depicted in FIG. 19.

Figure 19:
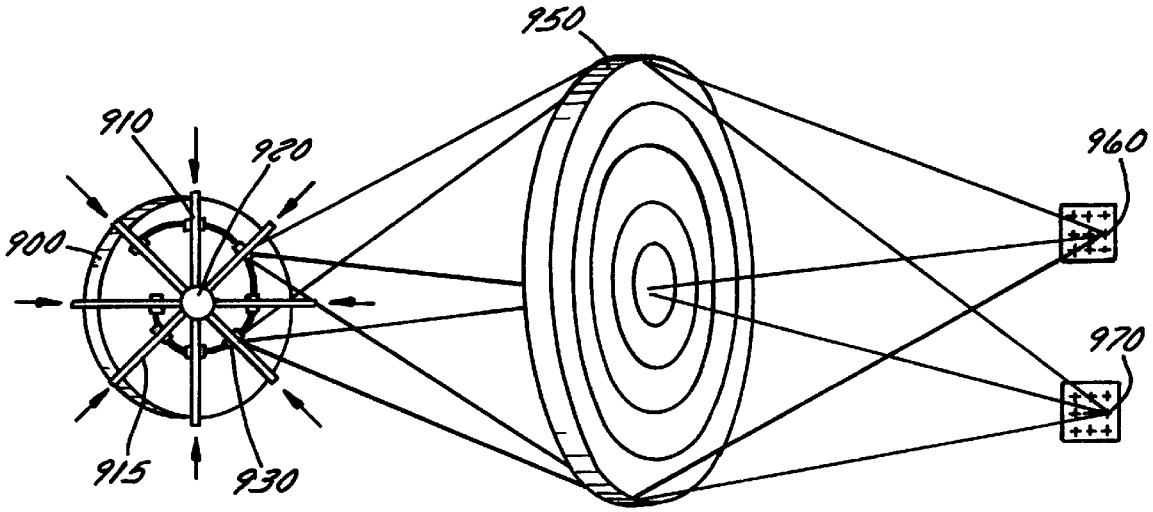
FIG. 19 illustrates a schematic perspective view of an imaging antenna according to the present invention.

Referring to FIG. 19, an imaging system based on a spiral arrangement of microstrip patches can be seen simultaneously scanning two object pixels. Grating assembly 900 is rotatably connected to waveguide assembly 910. Waveguide assembly 910 includes a plurality of waveguides 915 which are all connected to a centrally located load 920. The radially disposed arrows in FIG. 19 represent electromagnetic energy that is input to the plurality of waveguides 915 by a plurality of transceivers, (not shown). Grating assembly 900 includes a plurality of spirally disposed microstrip patches 930. Electromagnetic energy emanated from the plurality of waveguides 915 based on their interaction with the plurality of microstrip patches 930 travels toward millimeter wavelength zoned lens 950. Millimeter wavelength zoned lens 950 is a diffractive lens equivalent. It is analogous to a hologram. One side of millimeter wavelength zoned lens 950 can carry a diffraction grating that includes a surface relief of machined grooves. Although millimeter wavelength zoned lens 950 is like a Fresnel lens, the lens grooves are not exactly periodic and are unevenly spaced.

FIG. 19 illustrates two object pixels 960, 970 being simultaneously scanned. (Although waveguide assembly 910 includes eight waveguides, only two object pixels are shown for clarity.) When the plurality of microstrip patches 930 is in alignment beneath the plurality of waveguides 915, eight object pixels will be simultaneously scanned. As the grating assembly 900 rotates to its next adjacent interception of position with the serially adjacent set of waveguides, eight new object pixels will again be scanned but in rotationally advanced positions. Thus, 2D scanning by point source is carried out.

An example of such a microstrip patch antenna includes N=32 waveguide feeds situated radially with a common load at the center. Each waveguide is operated by an individual transceiver, (only the receiver portion is used in the passive mode). A rotating disk with M=32 microstrip patches is placed under the radial configuration of waveguides. The patches are arranged to form a spiral. Each patch, when it comes into proximity with the evanescent field of a waveguide, behaves as a MMW point source. In more detail, for a frequency of 94 GHz, the typical waveguide diameter and waveguide/patch separation are both about 1 mm. Using a MMW lens, the disk microstrip patches are imaged onto an object plane. As the disk rotates, the object points are detected by a system in a polar coordinate configuration.

Though shown in FIG. 19 as rectangular patches, the microstrip patches can be of various geometries. For instance, in order to accommodate a wide bandwidth and various polarizations, multilayered patches can be used. Further, each of the microstrip patches can be a multilayered patch designed to change polarization via capacitor connections. Such multilayered patches could be built up as alternating layers of metal and dielectric coated upon a dielectric substrate having opposing ground plane. Yet another example of a microstrip patch element is a multi-arm spiral configuration which can be termed spiraphase. Such small spiral microstrip patches provide circular polarization and a broader bandwidth.

Figure 20:
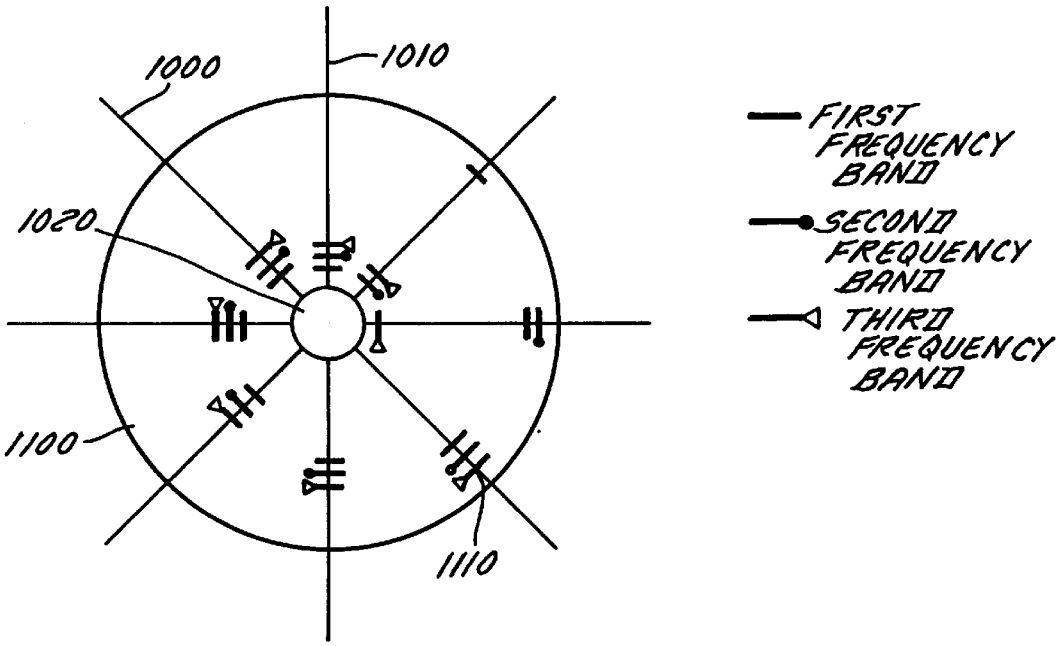
FIG. 20 illustrates a schematic view of a multiband configuration of microstrip patches according to the present invention.

Referring to FIG. 20, the effective depth of field from point source scanning can be increased by arranging the microstrip patches in spirally disposed sets. Waveguide assembly 1000 includes a plurality of waveguides 1010 that are radially electromagnetically connected to load 1020. Grating assembly 1100 includes a plurality of microstrip patches 1110 that are arranged in three frequency band sets. Each of the plurality of microstrip patches can be a multi-layered patch.

Just as in an optical camera, a MMW lens will permit the generation of a focused image from 1.5 m to infinity, (assuming a 50 cm focal length). The lens can be made of a low-loss plastic material, such as Teflon, either as a conventional lens, or as a zone plate to lower its weight and MMW absorption. It should be noted that a zone plate, or its adaption, a holographic lens, is frequency sensitive. This feature opens the possibility of imaging several object planes simultaneously, thus dramatically increasing the depth of field.

As pointed out in Table 1, small depth of field is one of the drawbacks of currently pursued focal plane array MMW systems. The following features would be preferred in order to accommodate multiplane, 3-D imaging: a wide operational frequency band divided into several sub-bands which can be detected and processed individually; a microstrip patch element designed as a narrow band resonator emitter; several sets of spirally distributed microstrip patches placed on a rotating disk, with each spiral set corresponding to a particular frequency sub-band, (a configuration with three spiral sets of microstrip patches is shown in FIG. 20 as an example); and a holographic lens designed to provide adequate focal lens dispersion as illustrated in FIG. 21.

Figure 21:
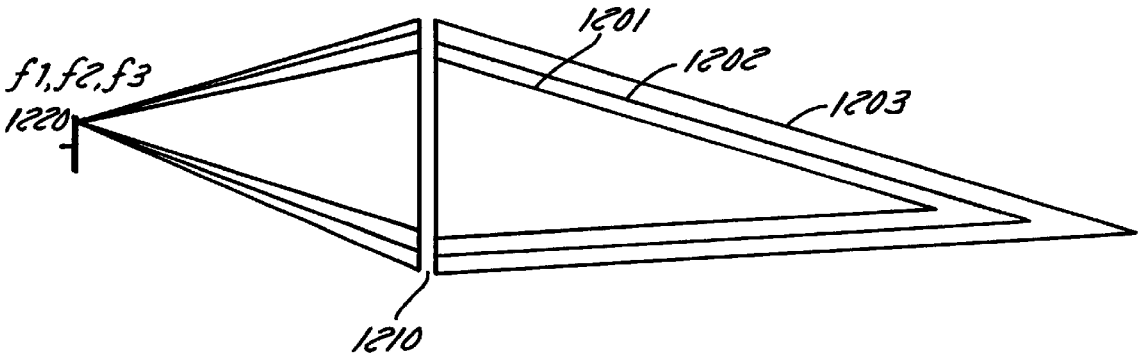
FIG. 21 illustrates a schematic view of a holographic MMW lens focusing different frequencies at different image planes providing increased depth of focus according to the present invention.

Referring to FIG. 21, the three different frequencies corresponding to one group of microstrip patches 1220 produce three discrete beam patterns 1201, 1202 and 1203. These three beam patterns are directed toward three focal points by millimeter wavelength zoned lens 1210.

It should be noted that the variation in focal length is proportional to the frequency and inversely proportional to the square of the lens f-number. The characteristics of one embodiment of a micropatch 2-D scanning antenna are given in Table 2.

TABLE 2

Antenna Characteristics

| PARAMETER | VALUE |
|---|---|
| Number of Resolution Pixels | 32 × 32 |
| Scanning rate | 30 frames/sec. |
| Number of Frequency sub-bands | 1 to 10 |
| Lens Aperture Diameter | 30 cm |
| Rotating Disk Diameter | 8 cm |

Obtaining a MMW image will require polar-to-Cartesian coordinate transformation. There are several methods of accomplishing this including the aforementioned approaches and a trade-off study for assessing computational power required verses available time for picture generation can indicate the most cost effective approach.

A practical application of the present invention which has value within the technological arts is concealed weapons detection based on the clarity of the image that is generated. Use of an efficient, low loss antenna permits better optimization of detection system parameters and therefore better sensitivity and resolution. Further, all the disclosed embodiments of the present invention are useful in conjunction with monitoring systems such as are used for the purpose of airport surveillance, or for the purpose of office building security, or remote sensing systems, or autonomous landing systems or the like. There are virtually innumerable uses for the present invention described herein, all of which need not be detailed here.

The present invention described herein provides substantially improved results that are unexpected. All the disclosed embodiments of the invention described herein can be realized and practiced using conventional materials, components and subcombinatorial procedures without undue experimentation. The entirety of everything cited above or below is hereby expressly incorporated by reference.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

For example, scanning performance could be enhanced by providing more complex cylindrical lenses. Similarly, although silica is preferred for the dielectric waveguide, any dielectric material could be used in its place, such as, for example, teflon. In addition, the individual components need not be fabricated from the disclosed materials, but could be fabricated from virtually any suitable materials.

Moreover, the individual components need not be formed in the disclosed shapes, or assembled in the disclosed configuration, but could be provided in virtually any shape, and assembled in virtually any configuration, which operate so as to provide 2-D scanning. Further, although the antenna described herein is a physically separate module, it will be manifest that the antenna may be integrated into the apparatus with which it is associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

REFERENCES

1. Radar Handbook, 2nd ed., McGraw Hill, (Merrill I. Skolnik ed., 1990).
2. Mark's Standard Handbook for Mechanical Engineers, 9th ed., McGraw Hill, (Eugene A. Avallone et al. eds., 1987).
3. Van Nostrand's Scientific Encyclopedia, 8th ed., Van Nostrand Reinhold, (Douglas M. Considine et al. eds., 1995).
4. The Electrical Engineering Handbook, CRC Press, (Richard C. Dorf et al. eds., 1993).
5. Handbook of Optics, 2nd ed., Vols. I–II, McGraw Hill, (Michael Bass et al. eds., 1995).
6. Bahaa E. A. Saleh & Malvin C. Teich, Fundamentals of Photonics, John Wiley & Sons, (1991).

What is claimed is:

1. An imaging antenna comprising:

a spindle assembly defining a rotation axis, said spindle assembly including:

a first rotational mounting for attachment to a platform so as to permit rotational motion about said rotation axis;

a shaft attached to said rotational mounting, said shaft being capable of rotational motion about said rotation axis;

a drive gear attached to said shaft;

a pinion gear attached to said drive gear; and a first motor attached to said pinion gear;

a waveguide assembly rotatably connected to said shaft so as to permit said waveguide assembly to rotate about said rotation axis, said waveguide assembly including:

a first dielectric waveguide defining a first axis that is substantially perpendicular to said rotation axis;

a first elongated cylindrical lens that i) is electromagnetically coupled to said first dielectric waveguide and ii) defines a lens axis that is substantially perpendicular to said rotation axis;

a second dielectric waveguide defining a second axis that is substantially parallel to said first axis; and a second elongated cylindrical lens that i) is electromagnetically coupled to said second dielectric waveguide and ii) defines a lens axis that is substantially perpendicular to said rotation axis; and a grating assembly rotatably connected to said shaft with a second rotational mounting so as to permit said grating assembly to rotate about said rotation axis independently of said waveguide assembly, said grating assembly including:

a substrate that i) is substantially normal to said rotation axis and ii) has a thickness a;

a reflective layer connected to said substrate, said reflective layer defining a plane that is substantially normal to said rotation axis, wherein $$a=\lambda \cos \phi/(4\in_d^{1/2})$$

where $\phi$ is a center of an angular scanning range, $\lambda$ is the wavelength of an electromagnetic source and $\in_d$ is a dielectric constant of said substrate; and a plurality of sectors connected to said substrate, each of said plurality of sectors including a varying period conductive grating pattern of separated strips, wherein a varying period of said varying period conductive grating pattern of separated metal strips is a function of an angle defined by a rotational position of said grating assembly with regard to said rotation axis.

2. The imaging antenna of claim 1 further comprising an optical link, said optical link including: a diode laser connected to said shaft; and a photodiode i) connected to said platform and ii) electromagnetically coupled to said diode laser.

3. An apparatus, comprising:

a spindle assembly defining a rotation axis;

a waveguide assembly connected to said spindle assembly, said waveguide assembly including a first dielectric waveguide defining a first axis; and a grating assembly comprising a rotatable disk connected to said spindle assembly, said grating assembly including a plurality of sectors, each of said plurality of sectors including a varying period conductive grating pattern, wherein a varying period of said varying period conductive grating pattern is a function of an angle defined by a rotational position of said grating assembly with regard to said rotation axis, and wherein said waveguide assembly and said grating assembly independently rotate coaxially relative to each other so as to provide two-dimensional scanning.

4. The apparatus of claim 3 wherein said spindle assembly includes a grating mounting for rotatably attaching said grating assembly to said spindle assembly so as to permit said grating assembly to rotate about said rotation axis.

5. The apparatus of claim 4 wherein said spindle assembly includes a waveguide mounting for rotatably attaching said waveguide assembly to said spindle assembly so as to permit said waveguide assembly to rotate about said rotation axis.

6. The apparatus of claim 5 wherein said waveguide assembly includes a receiver connected to said first dielectric waveguide and a transmitter connected to said first dielectric waveguide.

7. The apparatus of claim 5 wherein said waveguide assembly includes a second dielectric waveguide defining a second axis that is substantially parallel to said first axis and further comprising a receiver connected to i) said spindle assembly and ii) said first dielectric waveguide and a transmitter connected to i) said spindle assembly and ii) said second dielectric waveguide.

8. The apparatus of claim 4 wherein said waveguide assembly includes a second dielectric waveguide defining a second axis that is substantially perpendicular to said first axis.

9. The apparatus of claim 8 wherein said waveguide assembly includes a receiver connected to said first dielectric waveguide and a receiver connected to said second dielectric waveguide.

10. The apparatus of claim 9 wherein said spindle assembly includes a waveguide mounting for rotatably attaching said waveguide assembly to said spindle assembly so as to permit said waveguide assembly to rotate about said rotation axis and said waveguide assembly includes a third dielectric waveguide defining a third axis that is substantially parallel to said first axis and a fourth dielectric waveguide defining a fourth axis that is substantially perpendicular to said first axis and further comprising a transmitter connected to said third dielectric waveguide and a transmitter connected to said fourth dielectric waveguide.

11. The apparatus of claim 4 wherein said varying period conductive grating pattern includes a varying period conductive grating pattern of separated strips.

12. The apparatus of claim 11 wherein said varying period conductive grating pattern of separated strips includes a varying period conductive grating pattern of separated metal strips having non-uniform line width.

13. The apparatus of claim 4 wherein said varying period conductive grating pattern includes at least two gaps and at least one member selected from the group consisting of a digitally varying period conductive grating pattern and a steppingly varying period conductive grating pattern.

14. The apparatus of claim 4 further comprising an elongated cylindrical lens that is optically coupled to said first dielectric waveguide, said elongated cylindrical lens defining a lens axis that is substantially parallel to said first axis.

15. The apparatus of claim 4 further comprising a zone plate that is optically coupled to said first dielectric waveguide, said zone plate defining a plate plane that is substantially perpendicular to said rotation axis.

16. A method of making the apparatus of claim 4, comprising providing a grating substrate and photolithographically reproducing said plurality of sectors on said grating substrate.

17. An apparatus, comprising:

a spindle assembly defining a rotation axis;

a waveguide assembly connected to said spindle assembly, said waveguide assembly including a first dielectric waveguide defining a first axis;

a grating assembly connected to said spindle assembly, said grating assembly including a plurality of sectors, each of said plurality of sectors including a varying period conductive grating pattern; and wherein said spindle assembly includes a grating mounting for rotatably attaching said grating assembly to said spindle assembly so as to permit said grating assembly to rotate about said rotation axis, and wherein said grating assembly includes a substrate having a thickness a and reflective layer connected to said substrate, said reflective layer defining a plane that is substantially normal to said rotation axis, wherein $$a=\lambda \cos \phi/(4\in_d^{1/2})$$

where $\phi$ is a center of an angular scanning range, $\lambda$ is the wavelength of an electromagnetic source and $\in_d$ is a dielectric constant of said substrate, and wherein a varying period of said varying period conductive grating pattern is a function of an angle defined by a rotational position of said grating assembly with regard to said rotation axis.

18. The apparatus of claim 14, wherein said spindle assembly includes a waveguide mounting for rotatably attaching said waveguide assembly to said spindle assembly so as to permit said waveguide assembly to rotate about said rotation axis.

19. The apparatus of claim 18, wherein said waveguide assembly includes a second dielectric waveguide defining a second axis that is substantially parallel to said first axis and further comprising a receiver connected to i) said spindle assembly and ii) said first dielectric waveguide and a transmitter connected to i) said spindle assembly and ii) said second dielectric waveguide.

20. The apparatus of claim 18, wherein said waveguide assembly includes a second dielectric waveguide defining a second axis that is substantially perpendicular to said first axis.

21. The apparatus of claim 20, wherein said waveguide assembly includes a receiver connected to said first dielectric waveguide and a receiver connected to said second dielectric waveguide.

22. The apparatus of claim 21, wherein said spindle assembly includes a waveguide mounting for rotatably attaching said waveguide assembly to said spindle assembly so as to permit said waveguide assembly to rotate about said rotation axis and said waveguide assembly includes a third dielectric waveguide defining a third axis that is substantially parallel to said first axis and a fourth dielectric waveguide defining a fourth axis that is substantially perpendicular to said first axis and further comprising a transmitter connected to said third dielectric waveguide and a transmitter connected to said fourth dielectric waveguide.

23. The apparatus of claim 14, wherein said varying period conductive grating pattern includes a varying period conductive grating pattern of separated strips.

24. The apparatus of claim 23, wherein said varying period conductive grating pattern of separated strips includes a varying period conductive grating pattern of separated metal strips having non-uniform line width.

25. The apparatus of claim 14, wherein said varying period conductive grating pattern includes at least two gaps and at least one member selected from the group consisting of a digitally varying period conductive grating pattern and a steppingly varying period conductive grating pattern.

26. The apparatus of claim 14, further comprising an elongated cylindrical lens that is optically coupled to said first dielectric waveguide, said elongated cylindrical lens defining a lens axis that is substantially parallel to said first axis.

27. The apparatus of claim 14, further comprising a zone plate that is optically coupled to said first dielectric waveguide, said zone plate defining a plate plane that is substantially perpendicular to said rotation axis.

28. A method of making the apparatus of claim 14, the method comprising the step of:

photolithographically reproducing said plurality of sectors on said grating substrate.

29. An apparatus, comprising:

a spindle assembly defining a rotation axis;

a waveguide assembly connected to said spindle assembly, said waveguide assembly including a plurality of waveguides;

a grating assembly connected to said spindle assembly, said grating assembly including a plurality of microstrip patches, each of said microstrip patches including a conductive grating pattern; and wherein said grating assembly includes a substrate having a thickness a and reflective layer connected to said substrate, said reflective layer defining a plane that is substantially normal to said rotation axis, wherein $$a=\lambda \cos \phi/(4\in_d^{1/2})$$

where $\phi$ is a center of an angular scanning range, $\lambda$ is the wavelength of an electromagnetic source and $\in_d$ is a dielectric constant of said substrate.

30. The apparatus of claim 25 wherein said spindle assembly includes a grating mounting for rotatably attaching said grating assembly to said spindle assembly so as to permit said grating assembly to rotate about said rotation axis.

31. The apparatus of claim 26 wherein said waveguide assembly includes a plurality of transceivers, each of said plurality of transceivers being electromagnetically connected to one of said plurality of waveguides.

32. The apparatus of claim 27 wherein said waveguide assembly includes a load, said load being electromagnetically connected to each of said plurality of waveguides.

33. The apparatus of claim 25 further comprising a zone plate that is optically coupled to each of said plurality of waveguides, said zone plate defining a plate plane that is substantially perpendicular to said rotation axis.

34. The apparatus of claim 25 wherein each of said plurality of microstrip patches includes a multilayered patch.

35. The apparatus of claim 25 wherein each of said plurality of microstrip patches includes a spiral patch.

36. The apparatus of claim 25 wherein said plurality of microstrip patches are grouped in a plurality of spirally distributed sets, each of said spirally distributed sets including a plurality of narrow band resonator emitters.

37. A method of making the apparatus of claim 25, comprising providing a grating substrate and photolithographically reproducing said plurality of microstrip patches on said grating substrate.

38. An apparatus, comprising:

a spindle assembly defining a rotation axis;

a waveguide assembly connected to said spindle assembly, said waveguide assembly including:

a plurality of waveguides;

a load electromagnetically connected to each of said plurality of waveguides; and a plurality of transceivers, each of said plurality of transceivers being electromagnetically connected to one of said plurality of waveguides;

a grating assembly connected to said spindle assembly, said grating assembly including:

a substrate having a thickness a and reflective layer connected to said substrate, said reflective layer defining a plane that is substantially normal to said rotation axis, wherein $$a=\lambda \cos \phi/(4\in_d^{1/2})$$

where $\phi$ is a center of an angular scanning range, $\lambda$ is the wavelength of an electromagnetic source and $\in_d$ is a dielectric constant of said substrate;

a plurality of microstrip patches connected to said substrate, each of said microstrip patches including a conductive grating pattern, said plurality of microstrip patches being grouped in a plurality of spirally distributed sets, each of said spirally distributed sets including a plurality of narrow band resonator emitters; and a grating mounting for rotatably attaching said grating assembly to said spindle assembly so as to permit said grating assembly to rotate about said rotation axis; and a zone plate that is optically coupled to each of said plurality of waveguides, said zone plate defining a plate plane that is substantially perpendicular to said rotation axis.

39. The apparatus of claim 37 wherein each of said plurality of microstrip patches includes a multilayered patch.

40. The apparatus of claim 37 wherein each of said plurality of microstrip patches includes a spiral patch.

41. A method of making the apparatus of claim 37, comprising providing a grating substrate and photolithographically reproducing said plurality of microstrip patches on said grating substrate.

42. A method of two-dimensional imaging, the method comprising the steps of:

providing an imaging antenna comprising, a waveguide assembly connected to a spindle assembly, said waveguide assembly including a first dielectric waveguide defining a first axis;

a grating assembly comprising a rotatable disk connected to said spindle assembly, said grating assembly including a plurality of sectors, each of said plurality of sectors including a varying period conductive grating pattern, and wherein a varying period of said varying period conductive grating pattern is a function of an angle defined by a rotational position of said grating assembly with regard to said rotation axis, and wherein said waveguide assembly and said grating assembly independently rotate coaxially relative to each other so as to provide two-dimensional scanning;

rotating said grating assembly at a first angular velocity to produce a line scan;

rotating said waveguide assembly at a second angular velocity to produce a circular scan, said second angular velocity being less than said first angular velocity; and combining said line scan and said circular scan to produce a signal indicative of a two-dimensional image.

* * * * *